US010517391B1

(12) United States Patent
Fischer

(10) Patent No.: US 10,517,391 B1
(45) Date of Patent: Dec. 31, 2019

(54) PULLOUT LECTERN

(71) Applicant: Aron Fischer, Monsey, NY (US)

(72) Inventor: Aron Fischer, Monsey, NY (US)

( * ) Notice: Subject to any disclaimer, the term of this patent is extended or adjusted under 35 U.S.C. 154(b) by 0 days.

(21) Appl. No.: 15/983,138

(22) Filed: May 18, 2018

(51) Int. Cl.

| | |
|---|---|
| ***A47B 19/08*** | (2006.01) |
| ***A47B 13/08*** | (2006.01) |
| ***A47B 19/10*** | (2006.01) |
| ***A47B 1/10*** | (2006.01) |
| ***A47B 13/10*** | (2006.01) |

(52) U.S. Cl.
CPC ..... *A47B 19/08* (2013.01); *A47B 1/10* (2013.01); *A47B 13/081* (2013.01); *A47B 13/10* (2013.01); *A47B 19/10* (2013.01)

(58) Field of Classification Search
CPC ..... A47B 19/08; A47B 19/10; A47B 19/00; A47B 19/02; A47B 13/081; A47B 13/10; A47B 1/10
USPC ..... 312/310
See application file for complete search history.

(56) References Cited

U.S. PATENT DOCUMENTS 714,206 A * 11/1902 Lippincott ..... A47B 13/081 108/102
1,896,965 A * 2/1933 Madden ..... A47B 19/00 108/9
1,942,340 A * 1/1934 Madden ..... A47B 19/00 248/456
1,990,980 A * 2/1935 Fakkema ..... B42F 17/18 312/279
3,351,402 A * 11/1967 Barecki ..... A47B 19/00 108/13
3,362,766 A * 1/1968 Fontana ..... A47B 19/02 108/15
4,421,035 A * 12/1983 Gubbe ..... E05D 11/10 108/6
4,709,641 A * 12/1987 Lenger ..... A47B 13/081 108/102
5,452,951 A * 9/1995 Peller ..... H05K 7/16 108/6
6,033,046 A * 3/2000 Lambright ..... E06B 5/006 312/295
6,474,760 B2 * 11/2002 Rauls ..... A47B 21/0314 108/50.01
2006/0124822 A1 * 6/2006 Munda ..... A47B 19/00 248/454
2008/0011915 A1 * 1/2008 Landman ..... A45C 13/34 248/150

(Continued)

*Primary Examiner* — Hanh V Tran
(74) *Attorney, Agent, or Firm* — Michael J. Feigin, Esq.; Feigin & Fridman LLC

(57) ABSTRACT

A pullout lectern and shelf device are disclosed. The lectern is an angled or anglable substantially flat surface or portion thereof which is unobstructed in such a manner as to be designed for paper, books, small items, arms, or the like to rest thereon. A base unit has a top section, middle section, and bottom section, wherein each section has a different circumference than an adjacent section in one embodiment of the disclosed technology. The base unit has at least one shelf, and in some embodiments, three shelves. The lectern is slidably removable from the bottom section. An angle support mechanism attached to the lectern is operable to change an angle of the lectern relative to the base unit. The lectern has a mathematically similar shape to the base unit in some embodiments, this shape being one with at least six sides such as a hexagon or regular hexagon.

17 Claims, 8 Drawing Sheets

(56) References Cited

U.S. PATENT DOCUMENTS

| | | | | |
|---|---|---|---|---|
| 2012/0223035 | A1* | 9/2012 | Kelley, III | A47B 19/002<br>211/85.1 |
| 2012/0280600 | A1* | 11/2012 | Noel | A47F 7/286<br>312/139 |
| 2015/0034793 | A1* | 2/2015 | Roth | A47B 19/06<br>248/456 |
| 2015/0367501 | A1* | 12/2015 | Robinson | B32B 37/0046<br>156/752 |
| 2017/0099962 | A1* | 4/2017 | Ireland | A47F 3/06 |

* cited by examiner

PULLOUT LECTERN

SUMMARY OF THE DISCLOSED TECHNOLOGY

A pullout lectern and shelf device are disclosed. For purposes of this disclosure "lectern" is defined, in some embodiments of the disclosed technology, as an angled or anglable substantially flat surface or portion thereof which is unobstructed in such a manner as to be designed for paper, books, small items, arms, or the like to rest thereon. A "shelf" is, in some embodiments, a flat surface above or below another flat surface for resting an item thereon.

A base unit has a top section, middle section, and bottom section, wherein each section has a different circumference than an adjacent section in one embodiment of the disclosed technology. The top and bottom sections can have the same circumference (distance around the edges of the section, on average) where the middle section which is adjacent to each other section can have a smaller circumference. For purposes of this disclosure, the "top" and "bottom" are opposite sides, a bottom side being closer to a pullout drawer in embodiments of the disclosed technology. "Top" and "bottom" can be interchanged, in embodiments, as long as the cardinal directions used remain internally consistent.

The base unit has at least one shelf, and in some embodiments, three shelves. The shelves can be within the middle section. A lectern is slidably removable (in part or in whole, and in embodiments, while continuing to remain fixedly attached to the base unit) from the bottom section. An angle support mechanism (such as a hinge) attached to the lectern is operable to change an angle of the lectern relative to the base unit. The lectern has a mathematically similar shape to the base unit in some embodiments, this shape being one with at least six sides such as a hexagon or regular hexagon.

The device can further have rails attaching outer slidable pieces to the bottom section of the base unit as well as rails attaching an inner slidable piece to each of the outer slidable pieces as well as a rotatable end piece attaching the lectern to the inner slidable piece. The rotatable end piece is, or is part of the angle support mechanism in embodiments of the disclosed technology. The lectern is anglable between a flat position (e.g. a first angle in parallel and in line with a most elongated plane of the bottom section) and 30 degrees, 45 degrees, or 60 degrees there-from. When the lectern is at an acute angle with respect to the most elongated plane of the bottom section, retraction of the lectern into the bottom section (complete retraction or a majority thereof) is prevented by the lectern abutting the base unit.

In a fully retracted condition of the lectern into the base, in embodiments of the disclosed technology, a side of the lectern with a greatest surface area is in parallel with a most elongated side of the base. Further, in this condition, a side of said lectern with said greatest surface area is substantially hidden from view. Still further, in this condition, a side of said rotatable end piece with a greatest surface area is perpendicular to the side of the lectern with the greatest surface area.

The middle section of the base can have shelves which are unobstructed by the lectern in the fully retracted condition but which are at least partially obstructed by the lectern when the lectern is at an acute angle to the base unit. The angle support mechanism can have a handle adapted ("designed to" or "used to") to slide the lectern out from within the base unit as well as angle the lectern.

The angle support mechanism further has, in some embodiments, a wedge rotatably connected to a side of the lectern which is operable to maintain the lectern at a specific angle when wedged between grooves cut into a slidable piece of material which slides between a) being within the bottom section of the base unit and b) at least a majority or substantially external to the base unit. At least one said specific angle of the wedge and/or lectern is such that the lectern is supported at an angle such that the lectern extends into a plane above and parallel, or at and parallel to, to the top section.

Described another way, a pullout lectern and shelf device has a regular polygonal base with pullout drawer. A handle of the pullout drawer extends substantially a length of one side of the regular polygonal base and a plurality of shelves are within the base and above the pullout drawer. The lectern and the handle are connected by a fixed (non-rotatable) connection whereas the handle and drawer are rotatably connected. The drawer can have an inner and outer section which slide relative to one another. The inner section of the drawer, in such a case, can be rotatably connected to the drawer and linearly slidable with respect to the outer section of the drawer.

The lectern is rotatably connected to an angle support mechanism in some embodiments, the angle support mechanism (or wedge, as described above) being selectively placeable into any one of a plurality of grooves cut into the inner section of the drawer to support the lectern. The handle of the pullout drawer is abutted against the base when the pullout drawer is fully retracted into the base in some cases. In some embodiments of the disclosed technology, placing the angle support mechanism into any one of the plurality of grooves cut into the inner section of the drawer prevents the handle of the pullout drawer from abutting the base.

The top side and oppositely disposed bottom side of the base have edges of a same shape in some embodiments while the lectern has a mathematically similar shape thereto in some of these embodiments. Placing the angle support mechanism into a first of the plurality of grooves cut into the inner section of the drawer causes, in an embodiment of the disclosed technology, a (top edge) side of the lectern (opposite a side of the lectern fixed to the handle) to be aligned with a top of the base. The regular polygonal base and the lectern can be hexagonal.

Any device or step to a method described in this disclosure can comprise, or consist of, that which it is a part of, or the parts which make up the device or step. The term "and/or" is inclusive of the items which it joins linguistically, and each item by itself. Any object described can be as described or "substantially" as such wherein "substantially" is defined as "at least 95% true" or "at least 95% of the amount specified."

DETAILED DESCRIPTION OF EMBODIMENTS OF THE DISCLOSED TECHNOLOGY

A pullout lectern and shelf device are disclosed. The lectern is an angled or anglable substantially flat surface or portion thereof which is unobstructed in such a manner as to be designed for paper, books, small items, arms, or the like to rest thereon. A base unit has a top section, middle section, and bottom section, wherein each section has a different circumference than an adjacent section in one embodiment of the disclosed technology. The base unit has at least one shelf, and in some embodiments, three shelves. The lectern is slidably removable from the bottom section. An angle support mechanism attached to the lectern is operable to change an angle of the lectern relative to the base unit. The lectern has a mathematically similar shape to the base unit in some embodiments, this shape being one with at least six sides such as a hexagon or regular hexagon.

The device can further have rails attaching outer slidable pieces to the bottom section of the base unit as well as rails attaching an inner slidable piece to each of the outer slidable pieces as well as a rotatable end piece attaching the lectern to the inner slidable piece. The rotatable end piece is, or is part of the angle support mechanism in embodiments of the disclosed technology. The lectern is anglable between a flat position (e.g. a first angle in parallel and in line with a most elongated plane of the bottom section) and 30 degrees, 45 degrees, or 60 degrees there-from. When the lectern is at an acute angle with respect to the most elongated plane of the bottom section, retraction of the lectern into the bottom section (complete retraction or a majority thereof) is prevented by the lectern abutting the base unit.

In a fully retracted condition of the lectern into the base, in embodiments of the disclosed technology, a side of the lectern with a greatest surface area is in parallel with a most elongated side of the base. Further, in this condition, a side of said lectern with said greatest surface area is substantially hidden from view. Still further, in this condition, a side of said rotatable end piece with a greatest surface area is perpendicular to the side of the lectern with the greatest surface area.

Embodiments of the disclosed technology are described below, with reference to the figures provided.

Figure 1:
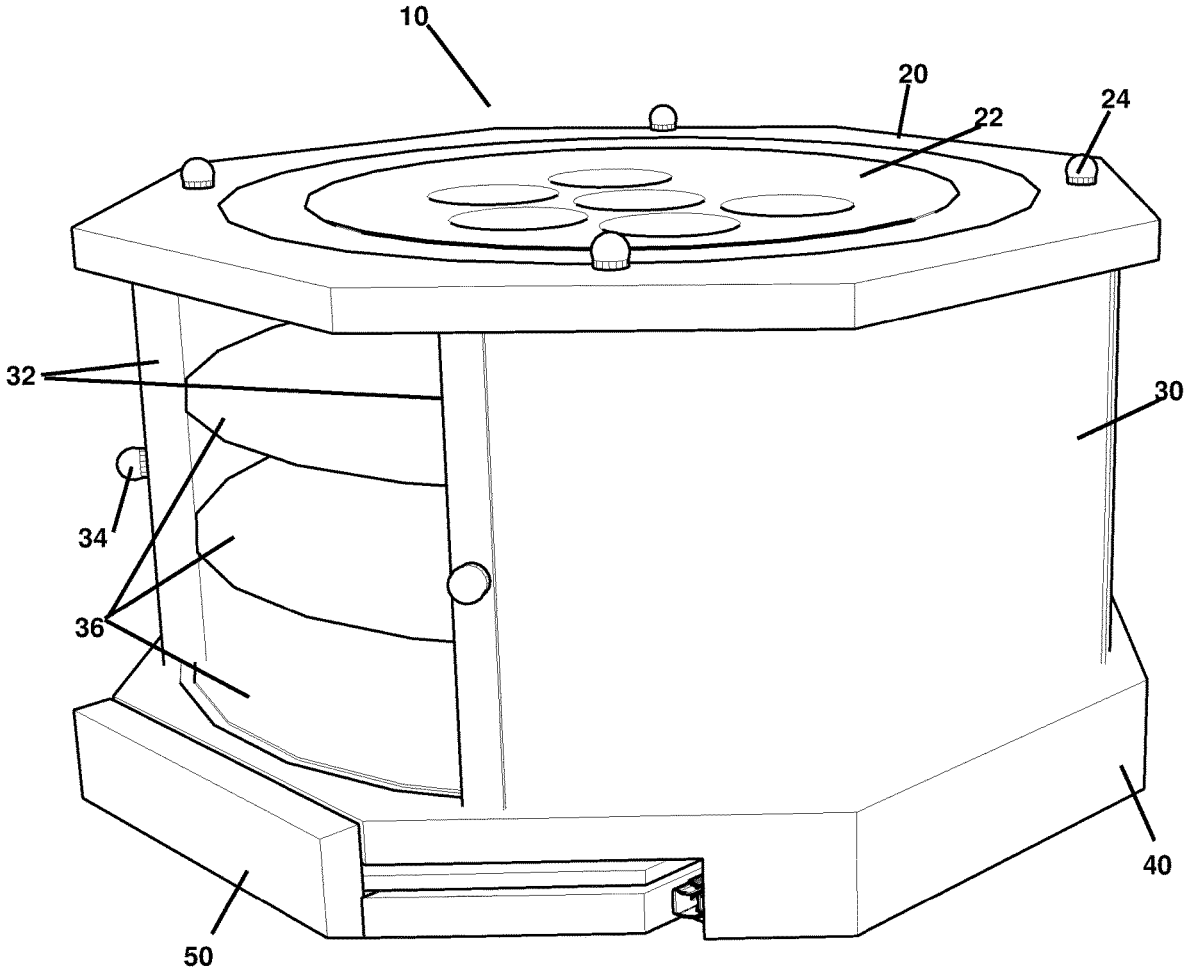
FIG. 1 shows a side perspective view of the base unit with pushed in drawer in an embodiment of the disclosed technology.

FIG. 1 shows a side perspective view of the base unit with pushed in drawer in an embodiment of the disclosed technology. The base unit 10 has outer walls including side walls 30 and a top wall/side 20. A plate 22 can be placed on top of or under a plane defined by the edges of the top wall 20. As such, the plate 22 can be indented into the top side 20. Screws 24 or other fasteners can hold the top side to the side walls 30. The side walls can have doors 32 with handles 34, the doors 32 selectively creating an opening there-between into an interior space of the base unit which can have a plurality of shelves 36 held within. A bottom section of the base unit 10 has side walls 40/is defined by the side walls 40 which, in embodiments of the disclosed technology, are wider than the the side walls 30 which are part of a middle region of the base unit 10. Thus, in embodiments of the disclosed technology, from top to bottom, are three distinct regions of the base unit distinguished by a change in exterior circumference (distance around the periphery of the base unit). There is a top section 10 having a wider circumference than a middle region with the side walls 30 and a bottom region with bottom side walls 40. The top and bottom region can have the same circumference or substantially the same.

A handle 50 of a lectern is adjacent (abuts) or forms a continuation with (is within the circumference of) the bottom walls 40. This handle, in embodiments of the disclosed technology has a length and width equal to or substantially equal to that of one side of the bottom walls 40. The bottom walls 40 with the handle 50 can form a regular polygon such as a hexagon or octagon. So too the side walls 30 of the middle region and/or side walls of the top region 20 can form such a polygonal or regular polygonal shape and each section can have the same mathematically shape or substantially the same mathematical shape.

Figure 2:
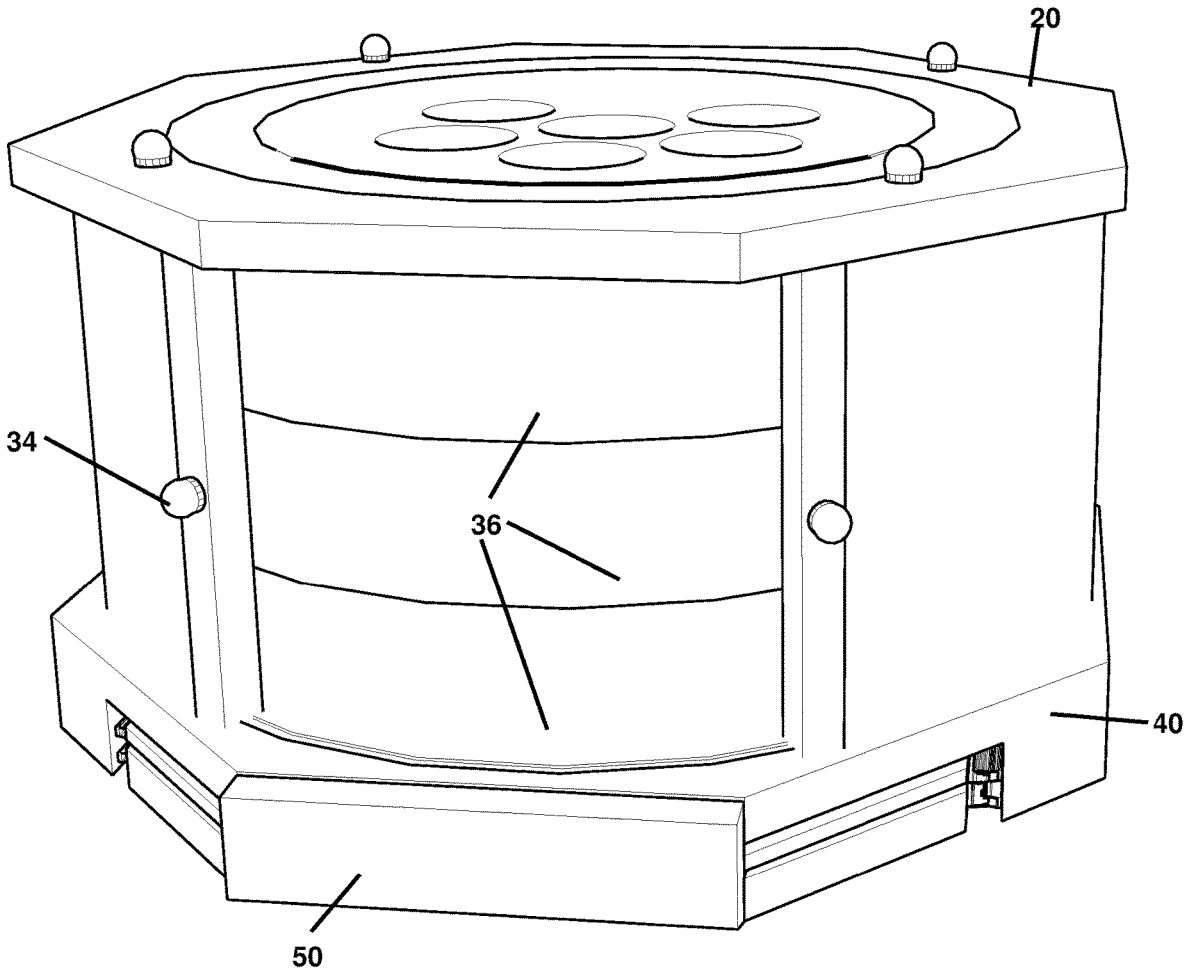
FIG. 2 shows a front perspective view of the base unit of FIG. 1.

FIG. 2 shows a front perspective view of the base unit of FIG. 1. In this view the handle 50 is seen in front of hexagonal bottom side walls 40. The doors with handles 34 are on either side of the opening into the interior of the base unit 10 showing the shelves 36. The doors are ornamental (immovable) in some embodiments of the disclosed technology.

Figure 3:
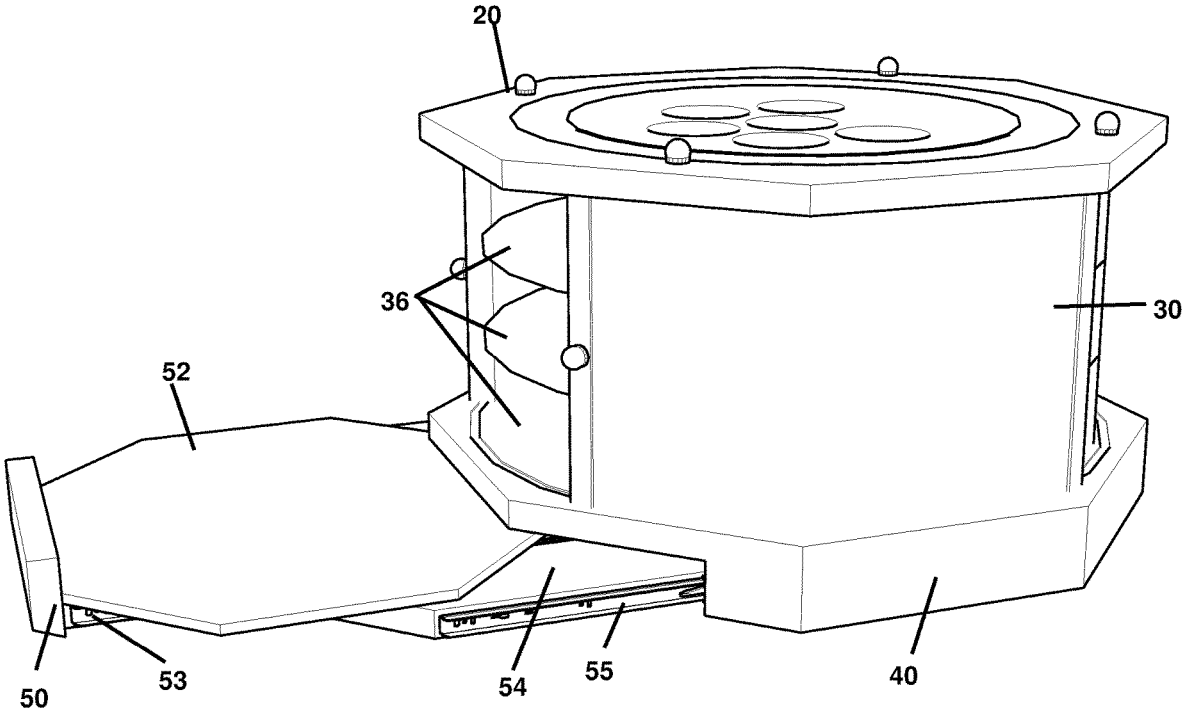
FIG. 3 shows a side perspective view of the base unit of FIG. 1 with a pulled out drawer in an embodiment of the disclosed technology.

FIG. 3 shows a side perspective view of the base unit of FIG. 1 with a pulled out drawer in an embodiment of the disclosed technology. The handle 50 is pulled linearly away from the base unit 10 revealing a lectern 52 having an elongated flat side which is at least five times longer on a flat side than a depth between the a top and bottom flat side. This lectern 52 in FIGS. 1 and 2, when the handle 50 was abutted against the bottom sides 40 of the base unit 10 was hidden (a majority or substantially all of) within the base unit. When viewed from the top looking down at the top side 20 of the base unit 10 the lectern 52 is completely hidden from view when the handle 50 is adjacent to or abuts the body of the base unit 10/bottom sides 40 in embodiments of the disclosed technology.

One or a plurality of drawers can slide out from the base unit 10 in sequence when the handle 50 is pulled away from the base unit 10. As shown in FIG. 3, there are rails 53 on a first inner drawer (section) and rails 55 on a second outer drawer (section) having a top side 54. These drawers move linearly/transverse to the height of the base unit 10, each in turn, with the handle 50 when the handle 50 is pulled from the base unit 10.

Figure 4:
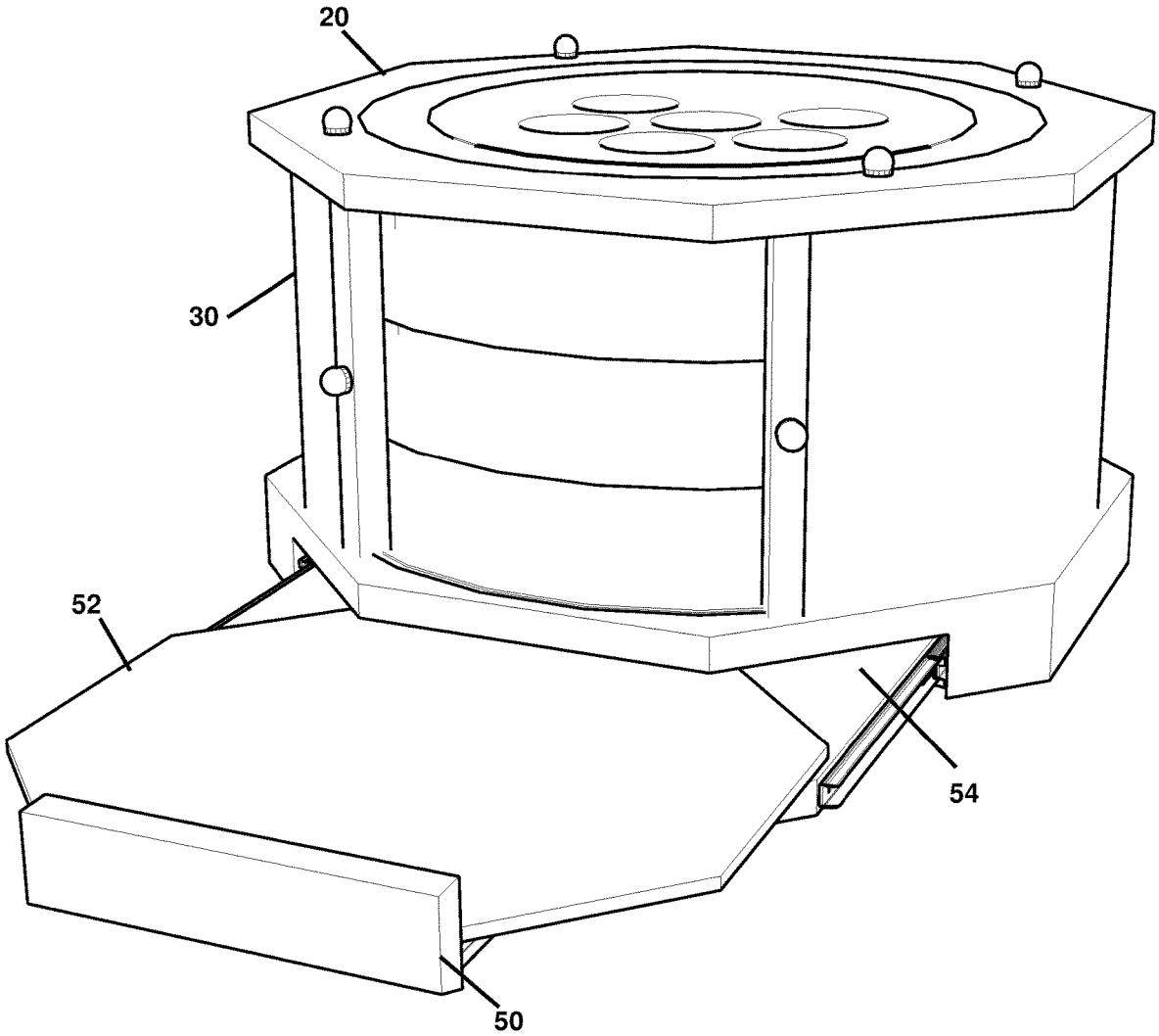
FIG. 4 shows a front perspective view of the base unit of FIG. 3.

FIG. 4 shows a front perspective view of the base unit of FIG. 3. The outer drawer 54 slidably connects to the base unit 10 (within a bottom section thereof) and slidably connects to the inner drawer. The inner drawer is rotatably connected to the handle 50. The lectern 52 is fixedly connected to the handle 50 in embodiments of the disclosed technology.

Figure 5:
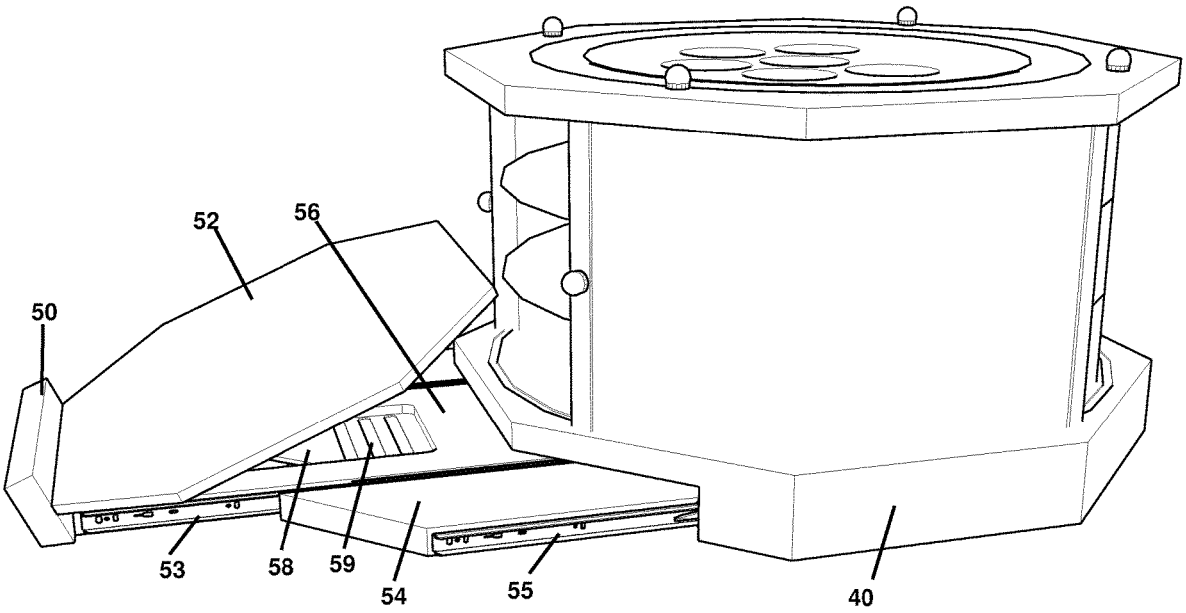
FIG. 5 shows a side perspective view of the base unit of the previous Figures with a pulled out drawer and angled lectern.

FIG. 5 shows a side perspective view of the base unit of the previous Figures with a pulled out drawer and angled lectern. Here one can see the outer drawer 54 with rails 55 and inner drawer 56 (labeled at the top side thereof) with rails 53. Note that the handle 50 is rotated with respect to the position thereof in the previous figures and that the lectern 42 rotates with the handle. In this embodiment, the lectern is at an acute angle to a top plane of the inner and outer drawers 56 and 54. To maintain this acute angle an angle support mechanism or wedge 58 supports the lectern 52.

The wedge 58 is wedged between the inner drawer 46 and lectern 52. In embodiments of the disclosed technology the lectern 52 is rotatably connected to the wedge 58 and the wedge 58 is held by way of frictional forces against a groove (or pit) 59 cut into/within the inner drawer 56. It should be understood that a hinge can be used to create any of the rotatable connections of embodiments of the disclosed technology and such hinges can have limits of minimum and maximum angles of rotation of two elements connected together by the hinge. The grooves 59 within the inner drawer are, in embodiments of the disclosed technology, within a rectangular depression cut into or formed within a top side of a drawer, such as the top side of the inner drawer 56. Within this rectangular depression are there an alternating series of deeper and less deep grooves such that the wedge 58, when pushed upon at an acute angle by the lectern 52, is pushed into one of the deeper grooves and against a side edge of one of the less deep grooves. The acute angle of pushing is relative to an elongated substantially flat top side or top plane of the drawer and for purposes of this disclosure the "top" side or direction refers to a side closest to the top 20 while the "bottom" is opposite this side closest to the bottom side 40.

Figure 6:
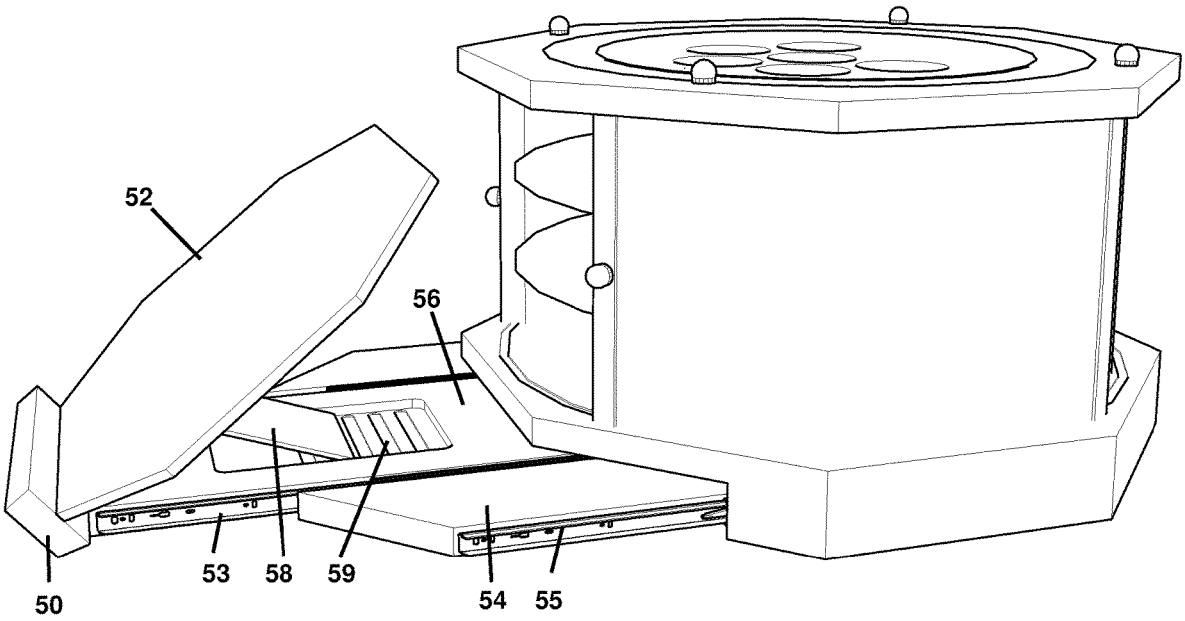
FIG. 6 shows a side perspective view of the base unit of the previous Figures with a pulled out drawer and a more obtusely angled lectern in an embodiment of the disclosed technology.

FIG. 6 shows a side perspective view of the base unit of the previous Figures with a pulled out drawer and a more obtusely angled lectern in an embodiment of the disclosed technology. Here the drawers are fully pulled out from the base unit 10 with a majority of each rail 53 and 55 having a majority thereof each exposed (unblocked by any of the objects described in this specification which connect directly or indirectly to the base unit 10). Note also that the angle of the lectern in FIG. 6 is more obtuse than the angle in FIG. 5 because the wedge 48 is abutted against a less deep groove of the grooves 59 which is closer to the handle 50 in FIG. 6 compared to FIG. 5.

Figure 7:
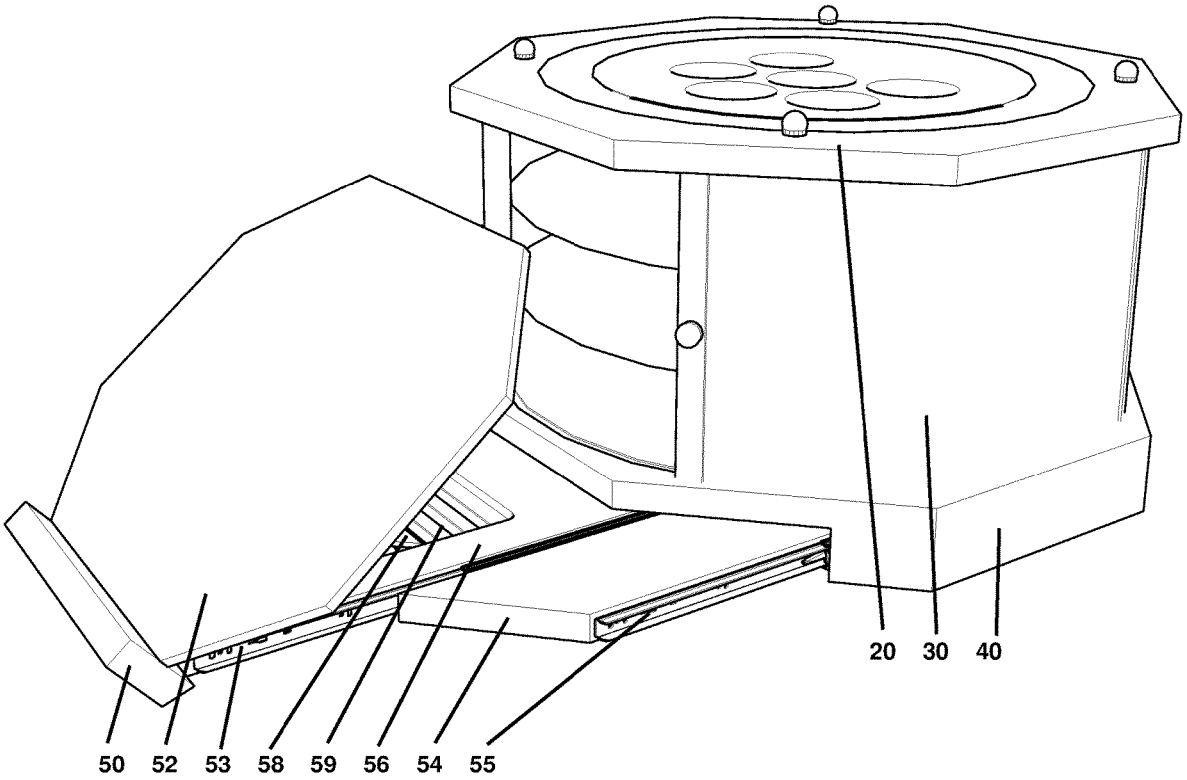
FIG. 7 shows a a front and side perspective view of the base unit of FIG. 6.

FIG. 7 shows a a front and side perspective view of the base unit of FIG. 6. Recapping the elements of the disclosed technology, the handle 50 rotates with respect to the drawers and is fixed with the lectern 52 such that the lectern and the handle 50 rotate in unison in embodiments of the disclosed technology. Note that the lectern and base unit 10, top 20 of the base unit, side walls 30, and bottom section 40 are all of a similar polygonal shape. The rails 53 of the inner drawer 56 slidably connect with a rail and pin within the rail fixedly attached to an outer drawer 54. The outer drawer 54 has it's own outer rail which slides along a pin extending into the rail within the bottom section 40 of the base unit 10. The base unit can have an identical sized top 20 and bottom 40 section with a smaller circumference middle section 30.

Figure 8:
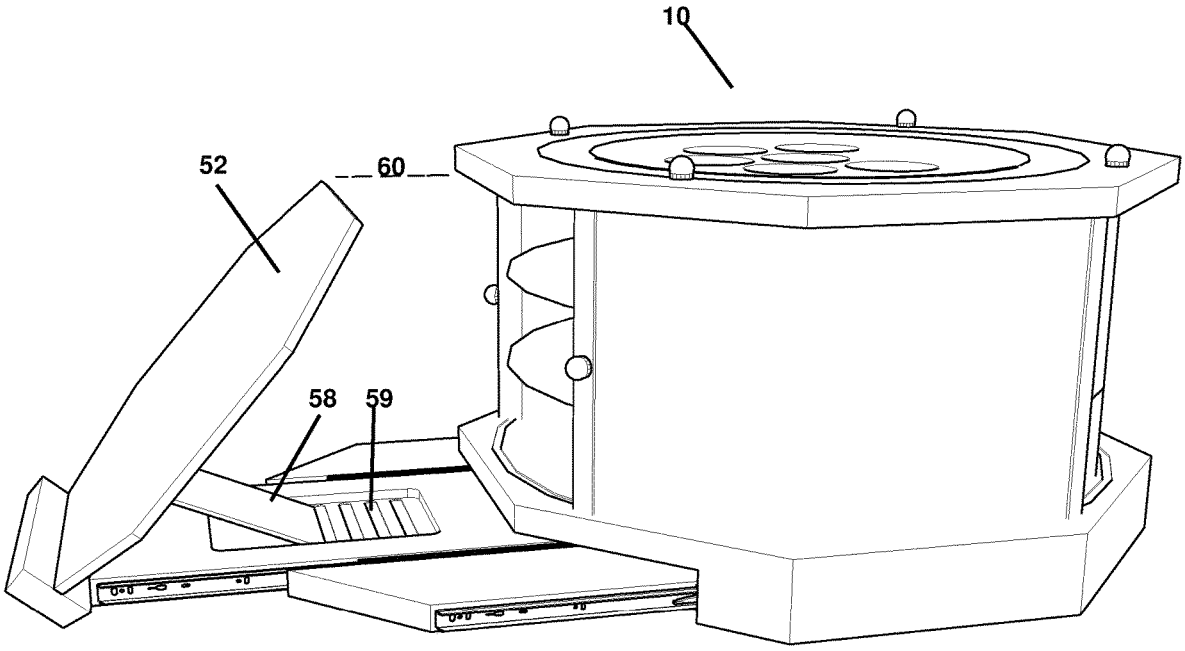
FIG. 8 shows another side perspective view of the base unit with a pulled out drawer and a fully raised lectern in an embodiment of the disclosed technology.

FIG. 8 shows another side perspective view of the base unit with a pulled out drawer and a fully raised lectern in an embodiment of the disclosed technology. Here, note that the top most edge of the lectern 52 is aligned just under the top section 20 of the base unit 10 along a horizontal plane 60. This plane lies between (adjacent to, e.g. within 3 cm) or on each of the top edge of the lectern 52 and underside of the top section 20 of the base unit 10. In this manner one can pull out the drawers completely, raise the lectern 52 relative to the drawers, and then slide the drawers partially back in to the base unit 10 so that the lectern 52 abuts the base unit 10. The lectern can abut the base unit under or at the top section thereof and/or fit between the doors and block part of the opening into the base unit.

In some embodiments of the disclosed technology, the device is a ka'ara used for the holiday of Pesach. The ka'ara is defined as a central physical device placed on a table during a seder of the Jewish holiday of Pesach which holds within, or is designed to hold there-within, two or three matzos and further has six or about six upper portals for placement of items referred to during the seder. The seder, or literally, "order" is the progression of retelling/reliving the story of the exodus of the Jews from Egypt in biblical times which is carried out during the holiday of Pesach. The ka'ara can be, in the disclosed technology, a pullout lectern and shelf device with a plurality of shelves within a base unit, a plate above the base unit, and a pullout drawer. The pullout drawer is, to the knowledge of the inventor, new over prior ka'ara devices. The pullout drawyer can be substantially hidden within the base unit or, at another time, slidably removed from and still attached to the base. The ka'ara can be used, such as in a method of use, to carry out some of the requirements in Jewish law, as codified in a work known as the "Shulchan Oruch" written by Rabbi Yosef Karo and commented on by Rabbi Moshe Isserles, for the seder on the holiday of Pesach.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A pullout lectern and shelf device comprising:

a base unit with a top section, middle section, and bottom section, wherein each section has a different circumference than an adjacent section;

at least one shelf within said middle section;

a lectern slidably removable from said bottom section; and an angle support mechanism attached to said lectern operable to change an angle of said lectern relative to said base unit;

wherein said lectern has a mathematically similar shape to said base unit, said mathematically similar shape having at least six sides.

2. The pullout lectern and shelf device of claim 1, further comprising:

rails attaching outer slidable pieces to said bottom section of said base unit;

rails attaching an inner slidable piece to each of said outer slidable pieces;

a rotatable end piece attaching said lectern to said inner slidable piece, said rotatable end piece being said angle support mechanism.

3. The pullout lectern and shelf device of claim 2, wherein said lectern is anglable between a first angle in parallel and in line with a most elongated plane of said bottom section and at least 30 degrees to said first angle.

4. The pullout lectern and shelf device of claim 3, wherein when said lectern is at an acute angle with respect to said most elongated plane of said bottom section, retraction of said lectern into said bottom section is prevented by said lectern abutting said base unit.

5. The pullout lectern and shelf device of claim 2, comprising a fully retracted condition wherein:

a side of said lectern with a greatest surface area is in parallel with a most elongated side of said base;

said side of said lectern with said greatest surface area is substantially hidden from view;

a side of said rotatable end piece with a greatest surface area is perpendicular to said side of said lectern with said greatest surface area.

6. The pullout lectern and shelf device of claim 5, wherein said middle section comprises shelves which are unobstructed by said lectern in said fully retracted condition but which are at least partially obstructed by said lectern when said lectern is at an acute angle to said base unit.

7. The pullout lectern and shelf device of claim 1, wherein said angle support mechanism comprises a handle adapted to slide said lectern out from within said base unit.

8. The pullout lectern and shelf device of claim 7, wherein said angle support mechanism further comprises a wedge rotatably connected to a side of said lectern which is operable to maintain said lectern at a specific angle when wedged between grooves in a slidable piece of material which slides between being within said bottom section of said base unit and at least substantially external to said base unit.

9. The pullout lectern and shelf device of claim 8, wherein at least one said specific angle is such that said lectern is supported at an angle such that said lectern extends into a plane above and parallel to said top section.

10. A pullout lectern and shelf device comprising:

a regular polygonal base with a pullout drawer, a handle of said pullout drawer extending substantially a length of one side of said regular polygonal base;

a plurality of shelves within said base and above said pullout drawer;

a fixed connection between a lectern and said handle; and a rotatable connection between said handle and said drawer;

wherein said drawer has an inner and outer section which slide relative to said base.

11. The pullout lectern and shelf device of claim 10, wherein said inner section of said drawer is rotatably connected to said drawer and linearly slidable with respect to said outer section of said drawer.

12. The pullout lectern and shelf device of claim 10, wherein said lectern is rotatably connected to an angle support mechanism which is selectively placeable into any one of a plurality of grooves cut into said inner section of said drawer to support said lectern.

13. The pullout lectern and shelf device of claim 12, wherein said handle of said pullout drawer is abutted against said base when said pullout drawer is fully retracted into said base.

14. The pullout lectern and shelf device of claim 13, wherein said angle support mechanism placed into any one of said plurality of grooves cut into said inner section of said drawer prevents said handle of said pullout drawer from abutting said base.

15. The pullout lectern and shelf device of claim 14, wherein a top side and an oppositely disposed bottom side of said base have edges of a same shape and said lectern has a mathematically similar shape thereto.

16. The pullout lectern and shelf device of claim 15, wherein placing said angle support mechanism into a first of said plurality of grooves cut into said inner section of said drawer causes a side of said lectern, which is opposite a side with said fixed connection to said handle, to be aligned with a top of said base.

17. The pullout lectern and shelf device of claim 16, wherein said regular polygonal base and said lectern are hexagonal.

* * * * *